United States Patent [19]

Grunert

[11] Patent Number: 4,973,928

[45] Date of Patent: Nov. 27, 1990

[54] EXTENDER SPRING FOR INCREASED MAGNETIC TRIP SETTINGS

[75] Inventor: Kurt A. Grunert, Beaver, Pa.

[73] Assignee: Westinghouse Electric Corp., Pittsburgh, Pa.

[21] Appl. No.: 331,920

[22] Filed: Mar. 31, 1989

[51] Int. Cl.[5] ..... H01H 75/10

[52] U.S. Cl. ..... 335/38; 335/42; 335/176

[58] Field of Search ..... 335/38, 39, 41, 42, 335/45, 172, 176

[56] References Cited

U.S. PATENT DOCUMENTS

| | | | |
|---|---|---|---|
| 3,777,293 | 12/1973 | Tuzuki | 335/42 |
| 4,503,408 | 9/1987 | Grunert et al. . | |
| 4,691,182 | 9/1987 | Mrenna et al. . | |
| 4,697,163 | 9/1987 | Mrenna et al. . | |
| 4,713,639 | 12/1987 | Grunert et al. | 335/42 |

*Primary Examiner*—H. Broome
*Assistant Examiner*—Lincoln Donovan
*Attorney, Agent, or Firm*—M. J. Moran

[57] ABSTRACT

A molded case circuit breaker is provided with a magnetic trip device which allow for a relatively wide range of adjustment. The magnetic trip device allows the magnetic air gap to be varied as well as the spring force on the plunger. Additionally, the magnetic trip device allows the force required to rotate the trip bar to be varied. By providing a means for adjust the force required to rotate the trip bar, the adjustment range of the magnetic trip device can be substantially enhanced. The molded case circuit breaker includes at least one pair of separable main contacts. The separable main contacts are mounted on upper and lower contact arms. The lower contact arm may be rigidly mounted to a line side conductor, while the upper contact arm is pivotally mounted to a load side conductor. The upper contact arm is mechanically coupled to an operating mechanism. A pivotally mounted trip bar is operatively coupled to the operating mechanism. In a normal condition, the trip bar allows the operating mechanism to be latched. When the trip bar is rotated, the operating mechanism becomes unlatched and opens the separable main contacts.

17 Claims, 3 Drawing Sheets

LOAD FORCE
PLUNGER POSITION
ADJUSTMENT LEVER 122 HIGH
ADJUSTMENT LEVER 122 LOW

EXTENDER SPRING FOR INCREASED MAGNETIC TRIP SETTINGS

CROSS REFERENCE TO RELATED APPLICATIONS

The invention disclosed herein relates to molded case circuit breakers.

The following seven patent applications all relate to molded case circuit breakers and were filed on Aug. 1, 1988: Serial No. 226,500, entitled RUBBER STOPS IN OUTSIDE POLES, William E. Beatty, Jr., Lawrence J. Kapples, Lance Gula and Joseph F. Changle, Westinghouse Case No. WE-54,532; Serial No. 226,648, entitled CT QUICK CHANGE ASSEMBLY, by Jere L. McKee, William E. Beatty, Jr. and Glenn R. Thomas, Westinghouse Case No. WE-54,533; Serial No. 226,503, entitled CROSS-BAR ASSEMBLY, by Jere L. McKee, Lance Gula, and Glenn R. Thomas, Westinghouse Case No. WE54,579; Serial No. 226,649, entitled LAMINATED COPPER ASSEMBLY, by Charles R. Paton, Westinghouse Case No. WE-54,580; Serial No. 226,650, entitled CAM ROLL PIN ASSEMBLY, by Lance Gula and Jere L. McKee, Westinghouse Case No. WE-54,594; Serial No. 226,655, entitled COMBINATION BARRIER AND AUXILIARY CT BOARD by Gregg Nissly, Allen B. Shimp and Lance Gula, Westinghouse Case No. WE-54,821; Serial No. 226,654, entitled MODULAR OPTION DECK ASSEMBLY by Andrew J. Male, Westinghouse Case No. WE-54,822.

The following four commonly assigned United States Patent Applications were filed on Oct. 12, 1988 and all relate to molded case circuit breakers: Serial No. 256,881 entitled SCREW ADJUSTABLE CLINCH JOINT WITH BOSSES, by James N. Altenhof, Ronald W. Crookston, Walter V. Bratkowski, and J. Warren Barkell, Westinghouse Case No. WE-54,694; Serial No. 256,879 entitled TAPERED STATIONARY CONTACT LINE COPPER, by Ronald W. Crookston, Westinghouse Case No. WE-54,695; Serial No. 256,880, entitled SIDE PLATE TAPERED TWIST-TAB FASTENING DEVICE FOR FASTENING SIDE PLATES TO THE BASE, by K. Livesey and Albert E. Maier, Westinghouse Case No. WE-54,715; Serial No. 256,878, entitled TWO-PIECE CRADLE LATCH FOR CIRCUIT BREAKER, by Albert E. Meier and William G. Eberts, Westinghouse Case No. WE-54,870.

The following commonly assigned United States Patent Application was filed on Oct. 21, 1988, which also relates to a molded case circuit breaker: Serial No. 260,848, entitled UNRIVETED UPPER LINK SECUREMENT, by Joseph Changle and Lance Gula, Westinghouse Case No. WE-54,713I.

Lastly, the following commonly assigned United, States patent application was filed on Apr. 3, 1989, which also relates to a molded case circuit breaker: Serial No.331,769, entitled ARC RUNNER, CONTAINMENT SUPPORT ASSEMBLY by Charles Paton, Kurt Grunert and Glen Sisson, Westinghouse Case No. WE-55,102.

BACKGROUND OF THE INVENTION

1. Field of the Invention

This invention relates to molded case circuit breakers and more particularly to an adjustable magnetic trip device which includes a tension spring for increasing the force required to operate the trip bar thereby extending the tripping range of the device.

2. Description of the Prior Art

Molded case circuit breakers are generally old and well known in the art. Examples of such circuit breakers are disclosed in U.S. Patent Nos. 4,503,408 and 4,697,163, assigned to the same assignee as the present invention. Such circuit breakers are used to protect electrical equipment, such as motors, from damage due to an overcurrent condition.

Such molded case circuit breakers include at least one pair of separable main contacts which may be operated either manually by way of a handle disposed on the outside of the case or automatically in response to an overcurrent condition. In the automatic mode of operation, the separable main contacts may be opened by either an operating mechanism or by magnetic repulsion forces generated by a reverse electrical current loop formed between the upper and lower contact arms.

The separable main contacts are mechanically coupled to an operating mechanism which includes a cradle member having a latching surface. A latch assembly includes pivotally mounted latch levers adapted to engage the latching surface on the cradle member to latch the operating mechanism to close the separable main contacts. When the latch lever is disengaged from the latching surface on the cradle member, the operating mechanism causes the separable main contacts to be opened. A pivotally mounted trip bar engages the latch lever. In a normal position, the trip bar allows the latch lever to latch the operating mechanism. However, when the trip bar is rotated, the latch lever becomes disengaged from the latching surface on the cradle member to allow the operating mechanism to trip or open the separable main contacts.

Various means have been used to actuate the trip bar to cause the separable main contacts to be tripped or opened. For example, bimetallic elements have been used. These bimetallic elements are comprised of strips of dissimilar metals which separate at predetermined levels of electrical current. Such bimetallic elements are serially connected between the load and line side terminals of the circuit breaker assembly such that all of the current that passes through the circuit breaker passes through the bimetallic element. Bimetallic elements are generally used to protect electrical circuitry or electrical loads from an overcurrent condition, generally about 200–300% of the nominal current rating of the circuit breaker.

Another known means of actuating a trip bar is an electronic trip unit. Such devices include internal current transformers electrically coupled to electronic circuitry. The current transforms only allow a portion of the current flowing through the circuit breaker to flow through the tripping device. Electronic trip units are adjustable and may provide overload protection as well as short circuit protection, generally 1000% or more of the nominal current rating of the circuit breaker.

In yet other circuit breakers, a magnetic tripping device is provided. This tripping device actuates the operating mechanism in response to relatively high overcurrent conditions. Such magnetic tripping devices are serially coupled between the line and load side terminals of the circuit breaker. The magnetic tripping device includes a coil and a reciprocally mounted plunger assembly. The plunger assembly includes a plunger carried by a carrier having a hammer portion which engages the trip bar when the plunger is attracted downwardly by the coil. The plunger is biased upwardly by an operating spring during normal current conditions defining a magnetic air gap between the plunger and the coil. When the electrical current flowing through the circuit breaker is sufficiently high, the magnetic attraction forces are generated between the plunger and the coil to overcome the upward spring force on the plunger. This causes the plunger to be attracted downwardly until the hammer portion of the carrier strikes the trip bar causing it to rotate to allow the operating mechanism to unlatch and trip or open the separable main contacts. The magnitude of the electrical current required to cause the magnetic tripping device to engage and rotate the trip bar (electrical tripping current) is dependent upon the spring force of the operating spring, the magnetic air gap and the force required to rotate the trip bar.

In order to provide an adjustable trip range for such magnetic trip devices either the magnetic air gap is varied or the spring force of the operating spring is varied, or a combination of the two. An example of such a magnetic tripping device is disclosed in U.S. Patent No. 4,697,163, assigned to the same assignee as the present invention. In this magnetic tripping device, means are disclosed for varying the spring force on the plunger as well as varying the magnetic air gap. By varying the spring on the plunger and the magnetic air gap, the the magnitude of the electrical tripping current at which the magnetic tripping device actuates the trip bar can be varied. However there are practical limits on the amount of adjustment that can be provided. In applications of a relatively large electrical tripping current an operating spring having relatively higher spring force is utilized. However, such an assembly cannot be adjusted low enough such that the magnetic trip device can also be used for applications requiring a relatively low electrical tripping current. Thus, separate magnetic tripping devices are required in such applications.

Molded case circuit breakers with such magnetic tripping devices are used in a wide variety of applications, such as for motor protection. In such applications, the motor size and corresponding inrush current values may vary substantially. Thus, it is necessary to provide as wide of an adjustment range on the magnetic trip d as possible. Known magnetic trip devices the electrical tripping current of which is varied by either changing the air gap, varying the spring force on the plunger, or a combination of the two, have provided an insufficient adjustment range.

SUMMARY OF THE INVENTION

It is an object of the present invention to provide a molded case circuit breaker which solves the problems associated with the prior art.

It is a further object of the present invention to provide a molded case circuit breaker which utilizes a magnetic trip device.

It is yet a further object of the present invention to provide a molded case circuit breaker with a magnetic trip device, adjustable over a relatively wide range.

It is a further object of the present invention to provide a molded case circuit breaker with a magnetic trip device wherein the force required to rotate the trip bar may be varied in order to vary the electrical tripping current required to trip the circuit breaker.

Briefly, the present invention relates to a molded case circuit breaker and, more particularly, to a molded case circuit breaker having a magnetic trip device which allows for a relatively wide range of adjustment. The magnetic tripping device in accordance with the present invention allows the magnetic air gap as well as the spring force on the plunger to be varied. Additionally, the magnetic tripping device allows the force required to rotate the trip bar to be varied. By providing a means for adjusting the force required to rotate the trip bar, the adjustment range of the magnetic trip device can be substantially enhanced.

The molded case circuit breaker includes at least one pair of separable main contacts, mounted on upper and lower contact arms. The lower contact arm may be rigidly mounted to a line side conductor, while the upper contact arm is pivotally mounted to a load side conductor. The upper contact arm is mechanically coupled to an operating mechanism. A pivotally mounted trip bar is operatively coupled to the operating mechanism. In a normal condition, the trip bar allows the operating mechanism to be latched and the separable main contacts to be closed. When the trip bar is rotated, the operating mechanism becomes unlatched which causes the separable main contacts to be opened.

A magnetic trip device cooperates with the trip bar to cause it to unlatch the operating mechanism during relatively high level overcurrent conditions. The magnetic tripping device includes a coil and a reciprocally mounted plunger assembly. The plunger assembly includes a plunger carried by a carrier having a hammer portion which engages the trip bar when the plunger is attracted downwardly by the coil. During relatively high level overcurrent conditions, a magnetic attraction force, generated by the coil attracts the plunger downwardly. The downward movement of the plunger causes the hammer portion of the corner to strike the trip bar and rotate it which, in turn, unlatches the operating assembly to allow the operating mechanism to open the main contacts. The plunger is mechanically coupled to the carrier by way of an operating spring, disposed between an adjustment lever and the carrier. The adjustment lever allows both the magnetic air gap as well as the opposing spring force provided by the operating spring to be varied. In addition, in order to extend the adjustment range of the magnetic tripping device, a tension spring is disposed between the adjustment lever and the trip bar to increase the force required to rotate the trip bar. By increasing the force required to rotate the trip bar, a relatively higher magnetic attraction force is required to actuate the trip bar which, in turn, requires a higher electrical tripping current. Means are also disclosed for varying the spring tension of the spring disposed between the trip bar and the adjustment lever.

DETAILED DESCRIPTION OF THE DRAWING

These and other objects and advantages of the present invention will become readily apparent upon consideration of the following detailed description and attached drawing, wherein:

FIG. 6 is a graph of the magnetic attraction force required to rotate the trip bar;

DETAILED DESCRIPTION

Figure 1:
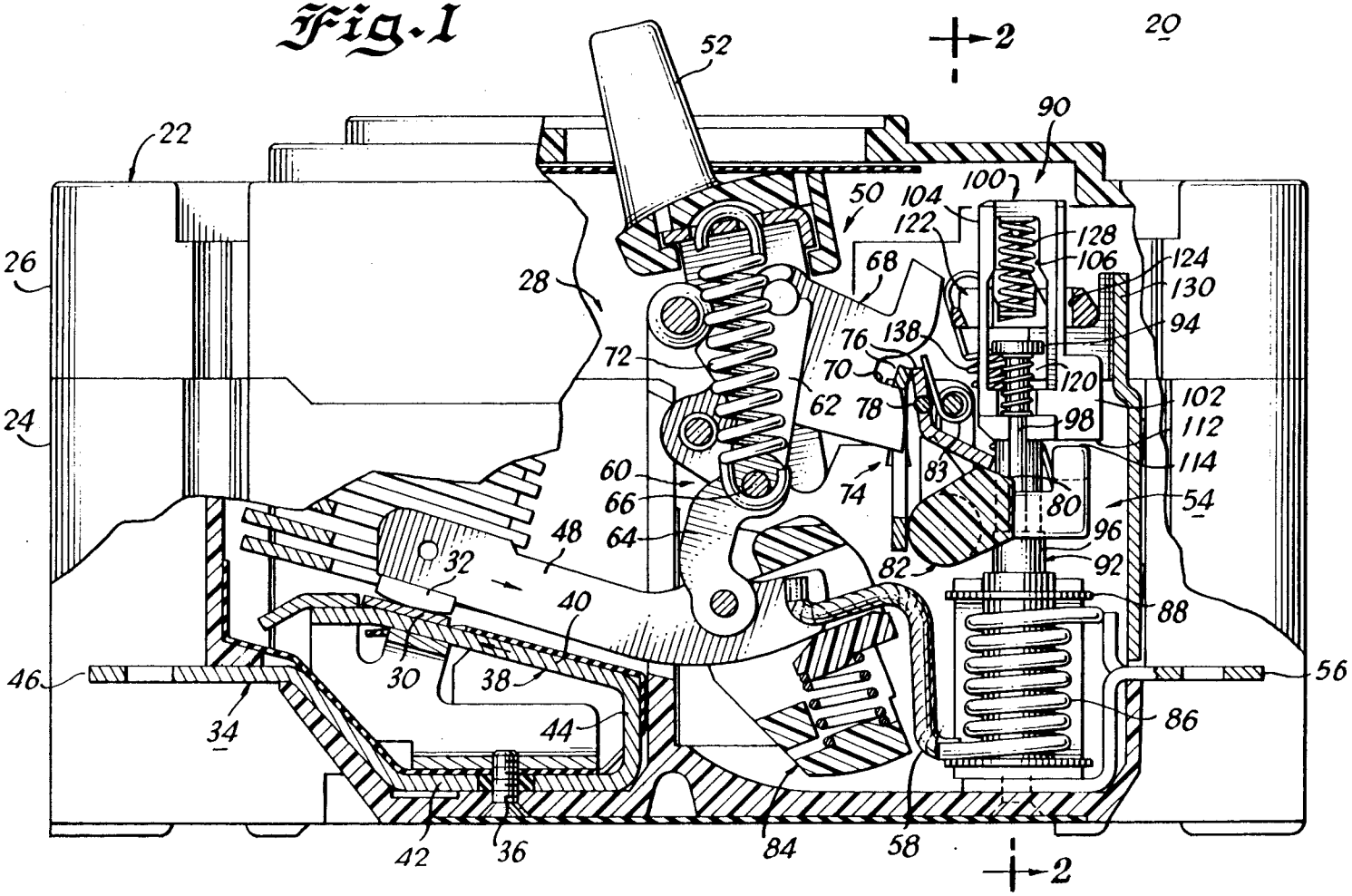
FIG. 1 is a side elevational view, partially broken away of the molded case circuit breaker in accordance with the present invention.
Figure 2:
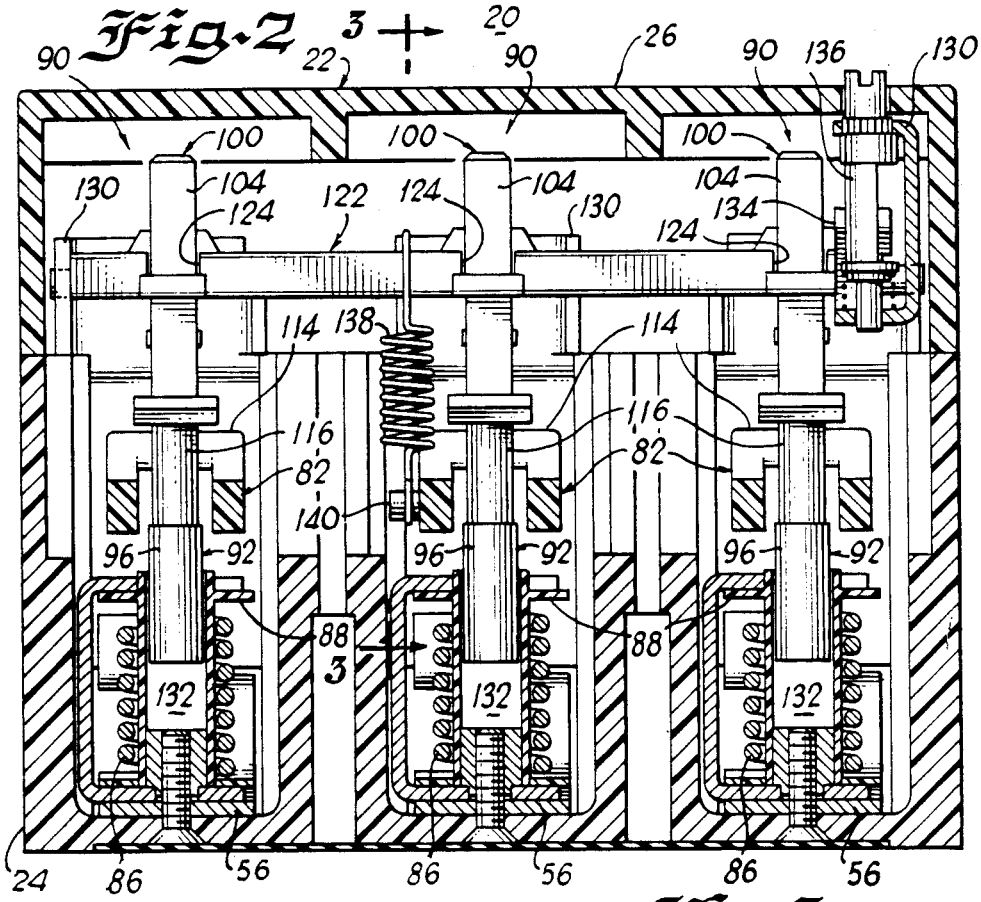
FIG. 2 is a transverse cross-sectional view taken along line 2—2 of FIG. 1.
Figure 3:
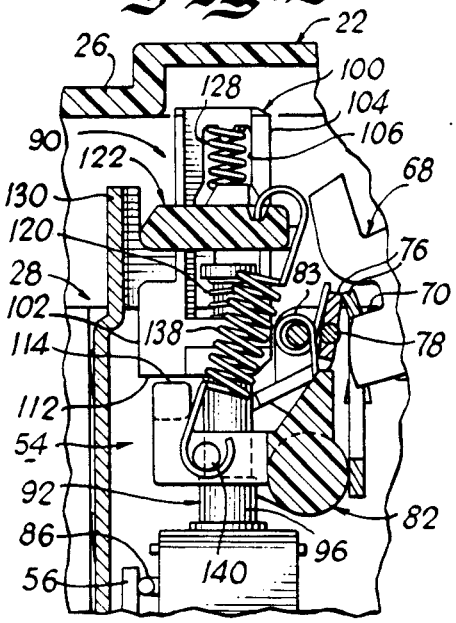
FIG. 3 is a cross-sectional view taken along line 3—3 of FIG. 2.

A molded case circuit breaker, generally indicated by the reference numeral 20, comprises an electrically insulated housing 22 having a molded base 24 and a molded coextensive cover 26. The internal portion of the base 24 is formed as a frame 28 for carrying the various components of the circuit breaker. As illustrated and described herein, a Westinghouse Series C, Type HMCP molded case circuit breaker will be described. However the principles of the present invention are applicable to various other types of molded case circuit breakers.

At least one pair of separable lower and upper main contacts 30 and 32 are provided within the housing 22. The lower main contact 30, carried by a lower contact arm 34, is rigidly mounted to the base 24. The lower contact arm 34 is secured to the base with a fastener 36.

The lower contact arm 34 is formed from an electrical conductor material, such as a flat copper bar. The flat copper bar is formed into a U-shaped portion 38 at one end defining a depending upper leg portion 40, a depending lower leg portion 42 and a bight portion 44. The upper leg portion 40 carries the lower main contact 30.

The other end of the lower contact arm 34 forms a line side conductor portion 46. A free end of the line side conductor portion 46 defines an electrical terminal to allow the line side of the circuit breaker 20 to be connected to an external electrical circuit (not shown).

The upper main contact 32 is carried by an upper contact arm 48 mechanically coupled to an operating mechanism 50 and an operating handle 52. The operating mechanism 50 does not form a part of the present invention and is similar to the operating mechanism described in detail in commonly assigned U.S. Patent No. 4,503,408, which is hereby incorporated by reference. The operating mechanism 50 allows the circuit breaker 20 to be operated manually by way of the operating handle 52 or automatically in response to an overcurrent condition detected by a magnetic tripping unit 54.

The upper contact arm 48 is electrically coupled to a load side conductor 56 by way of a flexible electrical conductor58, such as a woven copper braid. A free end of the load side conductor 56 forms an electrical terminal to allow the load side of the circuit breaker 20 to be connected to an external electrical circuit (not shown).

The U-shaped portion 38 of the lower contact arm 34 generates magnetic repulsion forces between the lower contact arm 34 and the upper contact arm 48 to cause the main contacts 30 and 32 to be blown apart during relatively high level overcurrent conditions. More specifically, during a relatively high level overcurrent condition, such as a short circuit condition, the electrical current flowing through the lower contact arm 34 and the upper contact arm 48 will be flowing in opposite directions as shown by the arrows in FIG. 1. Since the current in the upper and lower contact arms 48, 34 flows in opposite directions, magnetic repulsion forces are generated. During relatively high level overcurrent conditions, these magnetic repulsion forces cause the pivotally mounted upper contact arm 48 to blow open thus separating the upper and lower main contacts 32, 30 independent of the operating mechanism 50.

The operating mechanism 50 includes an over center toggle assembly 60 which includes a pair of upper toggle links 62 and a pair of lower toggle links 64. The upper toggle links 62 are pivotally connected at one end to the lower toggle links 64 forming a knee pivot 66. The lower toggle links 64 are pivotally connected to the upper contact arm 48. The upper toggle links 62 are pivotally connected to a cradle member 68. The cradle member 68 includes a latching surface 70 to allow the operating mechanism 50 to be latched. An operating spring 72 connected between the knee pivot 66 and the operating handle 52 causes the over center toggle mechanism 60 to collapse any time the cradle member 68 is unlatched a latch assembly 74. This causes the upper contact arm 48 to pivot upwardly.

The latch assembly 74 latches the cradle member 68 which, in turn, latches the over-center toggle assembly 60. The latch assembly 74 includes a pair of latch levers 76 pivotally mounted with respect to the circuit breaker frame 28 at pivot points 78. One end of the latch levers 76 engage the latching surface 70 on the cradle member 68. The other end of the latch levers 76 engage a cam surface 80 on a trip bar 82. The trip bar 82 is biased in a counter clockwise direction (FIG. 1) by a torsion spring 83. The free ends of the torsion spring 83 are disposed between the trip bar 82 and one of the latch members 76. One end of the torsion spring 83 may be positioned to provide either a relatively high torsion or a relatively lower torsion.

Figures 4, 5:
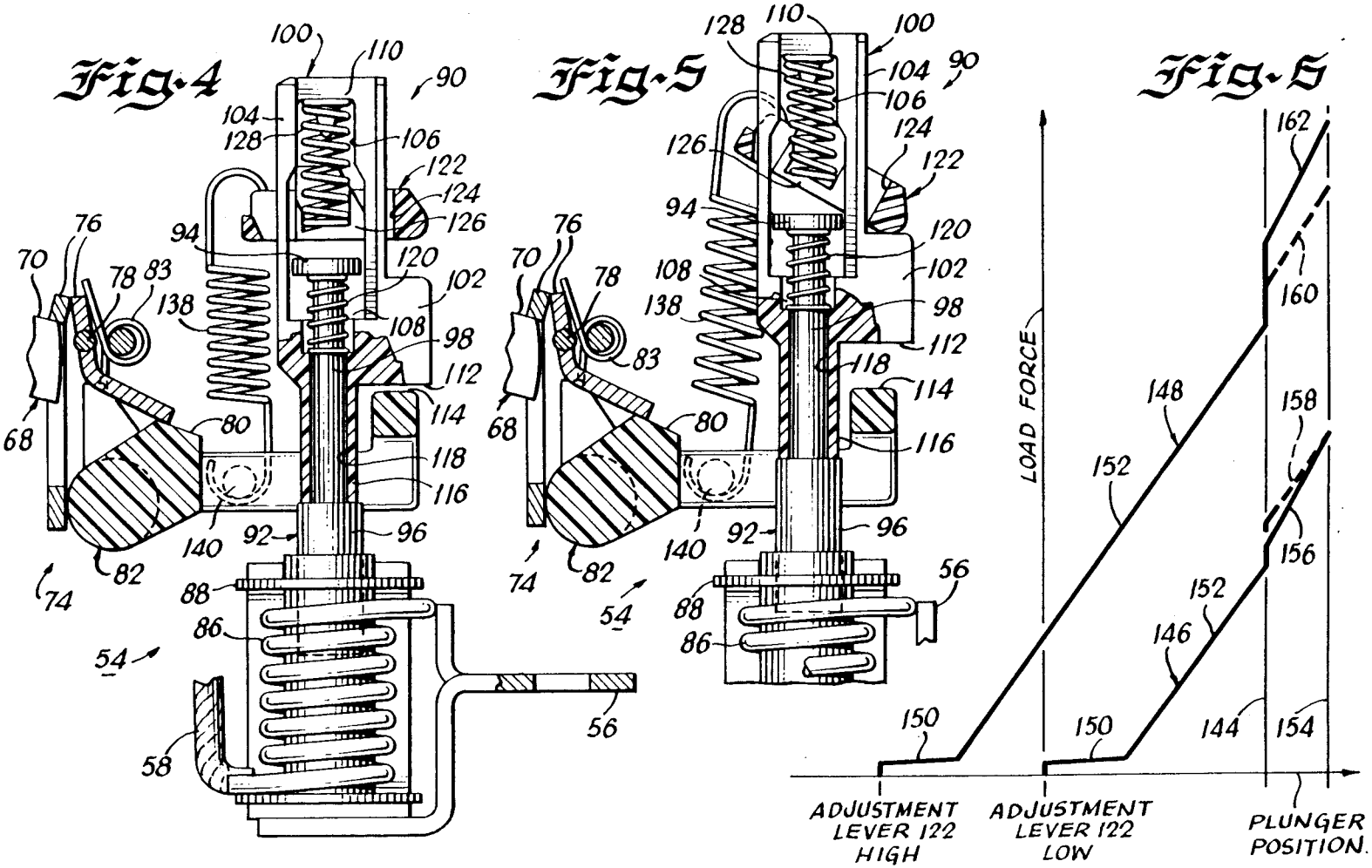
FIGS. 4 and 5 are stylized sectional views showing the operation of the present invention.

In operation, whenever the trip bar 82 is rotated in a clockwise direction (FIGS. 1, 4 and 5), the latch levers 76 become disengaged from the cam surface 80 on the trip bar 82. This disengages the latch levers 76 from the latching surface 70 on the cradle member 68 to allow the upper and lower toggle links 62, 64 to collapse under the force of the operating spring 72. Since the lower toggle links 64 are coupled to the upper contact arm, 48 by way of a crossbar 84 this causes the upper contact arm 48 to be moved upwardly.

The trip bar 82 is controlled by a magnetic trip device 54, which engages the trip bar 82 causing it to rotate in a clockwise direction (FIGS. 1, 4 and 5) thus disengaging the latch levers 76 from the cam surface 80 on the trip bar 82.

The magnetic trip device 54 includes a coil wound intermediate a bobbin 88 and a coaxially disposed, reciprocally mounted plunger assembly 90. The coil 86 is connected at one end to the flexible conductor 58 attached to the upper contact arm 48. The other end of the coil 86 is attached to the load side conductor 56. Thus, all of the electrical current flowing through the circuit breaker 20 flows through the coil 86.

The plunger assembly 90 includes a plunger 92 formed from a rod-like member having an enlarged portion at one end defining a head portion 94 and an enlarged portion at the other end forming a bottom portion 96, and defining a shank portion 98 therebetween. The plunger 92 is carried by a generally L-shaped carrier 100 having a depending horizontal leg 102 and a vertical leg. This carrier 100 has a centrally located window 106 in the vertical leg portion 104 of the L-shaped member defining a sill portion 108 and a head portion 110. A hammer portion 112, is formed in the horizontal leg portion 102. The hammer portion 112 is disposed to engage a striking surface 114 formed integral with the trip bar 82 to cause it to rotate to unlatch the latch assembly 74 and, in turn, the operating mechanism 50.

Disposed on the bottom portion of the carrier 100 is a guide portion 116 formed as a tubular member having an axial slot 118. The guide portion 116 may be integrally formed with the carrier 100 for receiving the shank portion 98 of the plunger 92 such that the head portion 94 of the plunger 92 is disposed upwardly from the sill portion 108 of the window 106. A time delay spring 120 is disposed between the sill portion 108 of the window 106 and the head portion 94 of the plunger 92. The time delay spring 120 is described in U.S. Patent No. 4,697,163 which is hereby incorporated by reference. Basically, the time delay spring 120 prevents the plunger 92 from reacting to temporary overcurrent conditions, which occur, for example, during the starting of a motor. In such an application, the motor in-rush current is often 400–500% of normal full load current. However, once the motor attains full load speed, the operating current reduces to the normal full load current. The time delay spring 120 adds a sufficient time delay to the operation of the magnetic tripping device 54 to override such temporary and common overcurrent conditions to prevent spurious tripping of the circuit breaker 20.

In a multiple pole circuit breaker, three magnetic tripping devices 54 are provided. However, plunger assemblies 90 for all three of the magnetic tripping devices 54 are mechanically coupled to a common adjustment lever 122. The adjustment lever 122 contains three rectangular slots 124 for slidably receiving the vertical leg portion 104 of the carrier 100. Each slot 124 is provided with a spring seat portion 126. The spring seat portion 126, integrally formed in the adjustment lever 122, permits operating springs 126 to be disposed between the spring seat portion 126 and the head portion 110 of the carrier 100 to mechanically couple the carrier 100 to the adjustment lever 122. The operating springs 128 biases the carrier 100 and consequently the plunger 92 upwardly. Thus, when the coil 86 is energized, the magnetic attraction force opposes the spring force of the operating spring 128.

The adjustment lever 122 is pivotally connected along a lengthwise edge to a pair of rigid frame member 130. The rigid frame members 130 are, in turn, rigidly attached to the circuit breaker frame 28. By pivotally attaching the adjustment lever 122 to the rigid frame members 130, the magnetic air gap 132 (the distance between the bottom of the plunger and the electric coil) can be varied as well as the spring force of the operating springs 128. More particularly, since the plunger 92 is mechanically coupled to the adjustment lever 122 by way of the operating springs 128, raising the adjustment lever 122 will cause the plungers 92 to be raised, thus increasing the magnetic air gap 132. As the carrier 100 is raised, the top surface of the hammer portion 112 engages the bottom of the adjustment lever 122, thus precluding further upward movement by the carrier 100. Since the operating springs 128 are also raised when the adjustment lever 122 is raised, additional compression of the operating springs 128 is required to allow the hammer portion 112 to rotate the trip bar 82. The additional compression requires a greater magnetic attraction force to overcome it, which is a function of the electrical tripping current.

Various means are contemplated for raising and lowering the adjustment lever 122. For example a cam follower 134 may be disposed at one end of the adjustment lever 122 which cooperates with a vertical cam. 136 The vertical cam 136 may be rotatably mounted in a rigid frame member 130. The vertical cam 136 may be formed from a rod-like member having a cam surface formed on its shank portion. Thus, by rotating the vertical cam 136, the adjustment lever 122 will be raised or lowered. Also, rotating the cam 136, the spring force of the operating springs 128 and the magnetic air gap 132 are varied.

An important aspect of the invention relates to the ability to extend the range of the electrical tripping current. This is done by increasing the force required to rotate the trip bar, thus requiring a higher magnetic attraction force to cause the hammer portion 112 to rotate the trip bar 82. Since the magnetic attraction force is a function of the electrical current flowing through the circuit breaker 20, varying the force required to rotate the trip bar 82 allows the electrical tripping current to be varied. More specifically, an additional tension or extender spring 138 is connected between the adjustment lever 122 and a pin 140 adjacent the pivot point on the trip bar 82.

Figure 7:
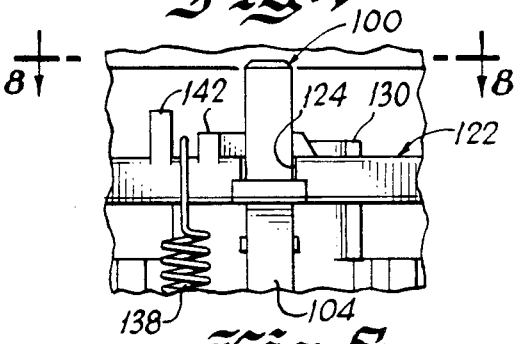
FIG. 7 is a partial view, similar to a portion of FIG. 2 illustrating an alternate embodiment of the present invention.
Figure 8:
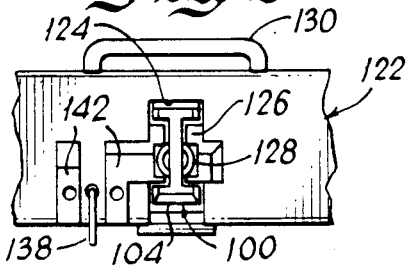
FIG. 8 is a plan view taken along line 8—8 of FIG. 7.

Means may also be provided for adjusting the spring tension in the extender spring 138. This may be accomplished by providing stepped surfaces (FIGS. 7 and 8) on top of the adjustment lever 122 By connecting the extender spring 138 to different stepped surfaces 142, the tension in the extender spring 138 can be varied.

An important aspect of the invention relates to the fact that the low adjustment setting of the adjustment lever 122 is relatively uneffected by the extender spring 138. This is illustrated in FIG. 6. The horizontal axis represents the plunger position while the vertical axis represents the required load force. The plunger position 144 relating to initial rotation of the trip bar and the position 15 relating to the plunger position relating to final rotation of the trip bar are indicated on the horizontal axis. The curve 146 on the right represents the load force required when the adjustment bar 122 is in its lowest position. The curve 148 on the left represents the situation when the adjustment lever 122 is in its highest position. The relatively portion 150 of the curve represents the negligible effect of the time delay spring 120 on the overall load force required. The relatively steep portion 152 of the curve up to the point 144 represents the magnetic attraction force required to overcome the force of the operating springs 128. In addition to the spring force of the operating springs 128, the rotational tension of the trip bar 82 must also be overcome. This causes the curve 146 and 148 to rise almost vertically at the point 144 where the trip bar 82 initially begins to rotate. Between this position 144 and the plunger position 154 corresponding to the final rotation of the trip bar 82, two rather steep portions of the curve are illustrated which indicate the effect of the additional extender spring 138 on the required magnetic attraction forces. Referring to the curve 146, the lower portion 156 represents the magnetic attraction forces required to overcome the force in the trip bar 82 without the additional extender spring 138. The portion 158 represents the magnetic attraction forces required to overcome the force in the trip bar 82 with the additional extender spring 138. As should be clear, these portions 156 and 158 converge, which illustrates that the additional extender spring 138 has a relatively insignificant effect on the magnetic attraction force required when the adjustment lever 122 is in its lowest adjustment position, thus preserving the low adjustment capability. However, it should also be noted that the portion 156 illustrates a relatively lower torsion on the torsion spring 83 while the portion 158 illustrates a relatively higher torsion on the torsion spring 83.

The curve on the left 148 illustrates that the the extender spring 138 has a relatively significant effect on the force required to cause the trip bar 82 to rotate. This curve 148 is similar to the curve 146 on the right. This curve 148 illustrates the adjustment lever 122 in an upward position. Since raising the adjustment lever 122 increases the magnetic air gap 132, a greater displacement of the plunger 92 is required before the hammer portion 112 engages the striking surface 114 of the trip bar 82. Also, since the operating springs 128 are raised, additional compression is required. At the high adjustment, the additional extender spring 138 significantly changes the tripping characteristics. More specifically, between the point 144 and the point 154, two relatively steep curve portions are shown. The upper portion 160 is representative of the magnetic attraction forces required with the additional extender spring 138. The lower portion 162 is representative of the magnetic trip forces required without the additional extender spring 138. As should be apparent at the higher adjustment, the additional extender spring 138 significantly increases the magnetic attraction forces required to rotate the trip bar. Since the magnetic attraction forces are a function of the electrical tripping current, it should be clear that the additional extender spring 138 allows the electrical tripping current to be varied. Consequently, the addition of the extender spring 138 greatly enhances the adjustment range of the magnetic trip device.

Obviously, many modifications and variations of the present invention are possible in light of the above teachings. Thus, it is to be understood that, within the scope of the appended claims, the invention may be practiced otherwise than as specifically described.

What is claimed and desired to be secured by Letters Patent is:

1. A molded case circuit breaker comprising:

a housing having a base portion defining a frame and a cover portion;

a lower main contact;

a lower contact arm serially connected to a first electrical terminal for carrying said lower main contact;

an upper main contact;

an upper contact arm, pivotally mounted with respect to said frame and serially connected to a second electrical terminal, for carrying said upper main contact;

an operating mechanism operatively coupled to said upper contact arm for actuating said upper contact arm;

a trip bar pivotally mounted with respect to said frame having a normal position and a trip position;

a latch assembly which communicates with said trip bar and said operating mechanism which latches the operating mechanism when the trip bar is in a normal position and unlatches the operating mechanism when the trip bar is in a trip position;

a magnetic tripping device for actuating said trip bar at a predetermined electrical tripping current, including a coil electrically coupled between said first electrical terminal and said second electrical terminal, and a reciprocally mounted plunger assembly, responsive to magnetic attraction forces generated by said coil when said predetermined electrical tripping current is flowing therethrough, said plunger assembly including a plunger, and a carrier for carrying said plunger and a hammer portion, said hammer portion being adapted to engage and rotate said trip bar;

adjustment means for varying the magnetic attraction forces required to rotate said trip bar; and a tension spring coupled between said adjustment means and said trip bar, said adjustment means having the characteristic of increasing the tension on said tension spring in relationship to the adjustment of said adjustment means thus requiring the amount of magnetic force necessary to trip said trip bar to be greater than if said adjustment means had not been adjusted.

2. A molded case circuit breaker as recited in claim 1, wherein said plunger assembly further includes an operating spring (90) coupled between, said carrier and said adjustment means for providing a spring force which opposes the magnetic attraction forces generated by the coil.

3. A molded case circuit breaker as recited in claim 2, wherein said adjustment means varies the opposing force generated by said operating spring, when said plunger is in a normal position.

4. A molded case circuit breaker as recited in claim 3, further wherein said adjustment means varies the magnetic air gap between said plunger and said coil, when said plunger is in a normal position.

5. A molded case circuit breaker as recited in claim 4 further including means for delaying the reaction of said plunger assembly in response to magnetic attraction forces generated by said coil.

6. A molded case circuit breaker as recited in claim 5, wherein said delaying means includes a spring coupled between said carrier and said plunger.

7. A molded case circuit breaker as recited in claim 1, wherein said adjustment means is pivotally mounted with respect to said circuit breaker frame.

8. A molded case circuit breaker as recited in claim 7, wherein said adjustment means is formed with a cam follower.

9. A molded case circuit breaker as recited in claim 8, further including a cam rotatably mounted with respect to said cam follower which causes said adjustment means to be responsive to rotation of said cam.

10. A molded case circuit breaker as recited in claim 1, wherein said adjustment means comprises a plurality of stepped surfaces, each stepped surface adapted to attenatively receive one end of said tension spring.

11. A molded case circuit breaker comprising:

a housing having a base portion defining a frame and a cover portion;

a lower main contact;

a lower contact arm serially connected to a first electrical terminal for carrying said lower main contact;

an upper main contact;

an upper contact arm pivotally mounted with respect to said frame and serially connected to a second electrical terminal for carrying said upper main contact;

an operating mechanism operatively coupled to said upper contact arm for actuating said upper main contact arm;

a trip bar pivotally mounted with respect to said frame having a normal position and a trip position;

a latch assembly which communicates with said trip bar and said operating mechanism which latches the operating mechanism when the trip bar is in a normal position and unlatches the operating mechanism when the trip bar is in a trip position;

a magnetic tripping device for actuating said trip bar at a predetermined electrical current, including a coil electrically coupled between said first electrical terminal and said second electrical terminal and a reciprocally mounted plunger assembly responsive to magnetic attraction forces generated by said coil when said predetermined electrical current is flowing through said coil, said plunger assembly including a plunger and a carrier having a hammer portion for carrying said plunger, said hammer portion being adapted to engage and rotate said trip bar;

adjustment means for adjusting the force required to rotate said trip bar;

means for adjusting the magnetic air gap; ad a tension spring coupled between said adjustment means and said trip bar, said adjustment means having the characteristic of increasing the tension on said tension spring in relationship to the adjustment of said adjustment means thus requiring the amount of magnetic force necessary to trip said trip bar to be greater than if said adjustment means had not been adjusted.

12. A molded case circuit breaker as recited in claim 11, wherein said plunger assembly further includes an operating spring coupled between said carrier and said adjustment means for providing a force which opposes the magnetic attraction force generated by the coil.

13. A molded case circuit breaker as recited in claim 14, wherein said adjustment means is formed with a plurality of stepped surfaces, each stepped surface adapted to receive said tension spring.

14. A molded case circuit breaker as recited in claim 11 further including means for delaying the react of said plunger assembly in response to magnetic attraction forces generated by said coil.

15. A molded case circuit breaker as recited in claim 13 wherein said delaying means includes a spring between said carrier and said plunger.

16. A molded case circuit breaker as recited in claim 14 wherein said adjustment means is pivotally mounted with respect to said circuit breaker frame.

* * * * *